US010519732B2

(12) United States Patent
Nguyen et al.

(10) Patent No.: US 10,519,732 B2
(45) Date of Patent: Dec. 31, 2019

(54) MUD PUMP ANNULAR FRICTION PRESSURE CONTROL SYSTEM AND METHOD

(71) Applicant: Hydril USA Distribution LLC, Houston, TX (US)

(72) Inventors: Dat Manh Nguyen, Houston, TX (US); Ahmet Duman, Houston, TX (US); Edward Walfred Eskola, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 162 days.

(21) Appl. No.: 15/608,510

(22) Filed: May 30, 2017

(65) Prior Publication Data

US 2018/0347300 A1 Dec. 6, 2018

(51) Int. Cl.

| | |
|---|---|
| ***E21B 21/08*** | (2006.01) |
| ***E21B 47/18*** | (2012.01) |
| ***E21B 21/10*** | (2006.01) |
| ***E21B 47/06*** | (2012.01) |

(52) U.S. Cl.

CPC ..... *E21B 21/08* (2013.01); *E21B 21/10* (2013.01); *E21B 47/06* (2013.01); *E21B 47/187* (2013.01)

(58) Field of Classification Search

CPC ..... E21B 21/08; E21B 21/10; E21B 47/06; E21B 47/187; E21B 43/12; E21B 21/001; E21B 21/00; F04B 43/02; F04B 47/02

See application file for complete search history.

(56) References Cited

U.S. PATENT DOCUMENTS

| | | | | |
|---|---|---|---|---|
| 4,074,779 | A | 2/1978 | Cheung et al. | |
| 6,102,673 | A * | 8/2000 | Mott | E21B 21/001 137/596.17 |
| 8,430,112 | B2 | 4/2013 | Matheis et al. | |
| 9,534,458 | B2 * | 1/2017 | Duman | E21B 21/001 |
| 2014/0137442 | A1 | 5/2014 | Jones et al. | |
| 2014/0318803 | A1 | 10/2014 | Patriciu | |
| 2015/0240578 | A1 * | 8/2015 | Duman | F04B 43/02 166/351 |

FOREIGN PATENT DOCUMENTS

WO 2015/005782 1/2015

OTHER PUBLICATIONS

Stuart Leach et al., "SME Special Session: Subsea Slurry Lift Pump Technology—SMS Development," Offshore Technology Conference, Apr. 30-May 3, 2012, Houston, TX.

* cited by examiner

*Primary Examiner* — Yong-Suk Ro
(74) *Attorney, Agent, or Firm* — Hogan Lovells US LLP

(57) ABSTRACT

A method of controlling bottom hole pressure in a wellbore, including pumping drilling mud into the wellbore, estimating the annular friction pressure in the wellbore, and measuring the pressure of the drilling mud exiting the wellbore. The method includes measuring the flow rate of the drilling mud exiting the wellbore, and, based on the pressure of the drilling mud exiting the wellbore, the flow rate of the drilling mud exiting the wellbore, expected annular friction pressure in the wellbore, and rotational speed of drill string in the wellbore, controlling the flow rate of drilling mud exiting the wellbore to achieve a specified bottom hole pressure.

20 Claims, 4 Drawing Sheets

MUD PUMP ANNULAR FRICTION PRESSURE CONTROL SYSTEM AND METHOD

BACKGROUND

1. Field of Invention

This invention relates in general to equipment used in the hydrocarbon industry, and in particular, to systems and methods for subsea drilling operations.

2. Description of the Prior Art

During certain subsea oil and gas drilling operations, it is desirable to know the bottom hole pressure in the wellbore. Such information can help to increase safety and mitigate risk by allowing an operator to manage pressure in the wellbore. Such pressure management can occur by increasing the flow rate of drilling mud into the wellbore relative to the flow rate out of the wellbore.

One problem with known systems and methods is the difficulty of determining the bottom hole pressure in the wellbore, and to accordingly set appropriate relative flow rates of drilling mud into and out of the wellbore. The determination of bottom hole pressure is complicated by a multitude of factors. Such factors include, for example, annular friction pressure losses, drill string rotational speed, and others. There is a need, therefore, for systems and methods to accurately calculate bottom hole pressure in wellbores, and to control the flow of drilling mud through such wellbores to adjust such pressures as needed.

SUMMARY

One embodiment of the present technology provides a system for controlling bottom hole pressure in a wellbore during oil and gas drilling operations. The system includes a bottom hole pressure controller containing data about drilling parameters and expected annular friction pressure in the wellbore, a rig pump that pumps drilling mud into the wellbore via a mud supply line, and a mud pump that controls the flow rate of the drilling mud out of the wellbore after the drilling mud circulates through the wellbore. The system further includes a valve associated with the mud pump that has an open position for permitting drilling mud to flow through the pump and a closed position for preventing drilling mud from flowing through the pump, the valve in the open position when pressure in the mud inlet line increases above a setpoint, and in the closed position when pressure in the mud inlet line is below the setpoint. In addition, the system includes a pressure transducer in the mud inlet line that measures mud inlet line pressure data and communicates the mud inlet line pressure data to the controller, and a flow meter in fluid communication with the mud pump that measures fluid flow rate through the mud pump and communicates fluid flow rate data to the controller. In some embodiments, the controller combines the mud inlet pressure data and the fluid flow rate data with the data about drilling parameters and expected annular friction pressure to determine the setpoint of the valve to control bottom hole pressure in the wellbore.

An alternate embodiment of the present technology provides a method of controlling bottom hole pressure in a wellbore. The method includes the steps of pumping drilling mud into the wellbore, estimating the annular friction pressure in the wellbore, measuring the pressure of the drilling mud exiting the wellbore, and measuring the flow rate of the drilling mud exiting the wellbore. In addition, based on the pressure of the drilling mud exiting the wellbore, the flow rate of the drilling mud exiting the wellbore, expected annular friction pressure in the wellbore, and rotational speed of drill string in the wellbore, the method can include controlling the flow rate of drilling mud exiting the wellbore to achieve a specified bottom hole pressure.

Yet another embodiment of the present technology provides a method of controlling bottom hole pressure in a wellbore, including the steps of pumping drilling mud into a wellbore with a rig pump, and pumping drilling mud, after circulation through the wellbore, from the wellbore to a rig with a mud pump, the mud pump having a mud inlet line, a mud outlet line, a water supply line, and a water discharge line. The method further includes attaching a pressure transducer to the mud inlet line to determine the pressure of the drilling mud exiting the wellbore, and attaching a flow meter to the water discharge line to measure the flow rate of drilling mud through the mud pump. In certain embodiments, the method can also include combining data from the pressure transducer, data from the flow meter, expected annular friction pressure in the wellbore, and rotational speed of drill string in the wellbore, to calculate a desired flow rate of drilling mud from the wellbore to achieve a desired down hole pressure, and adjusting a valve associated with the mud pump to control the flow rate of drilling mud from the wellbore.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
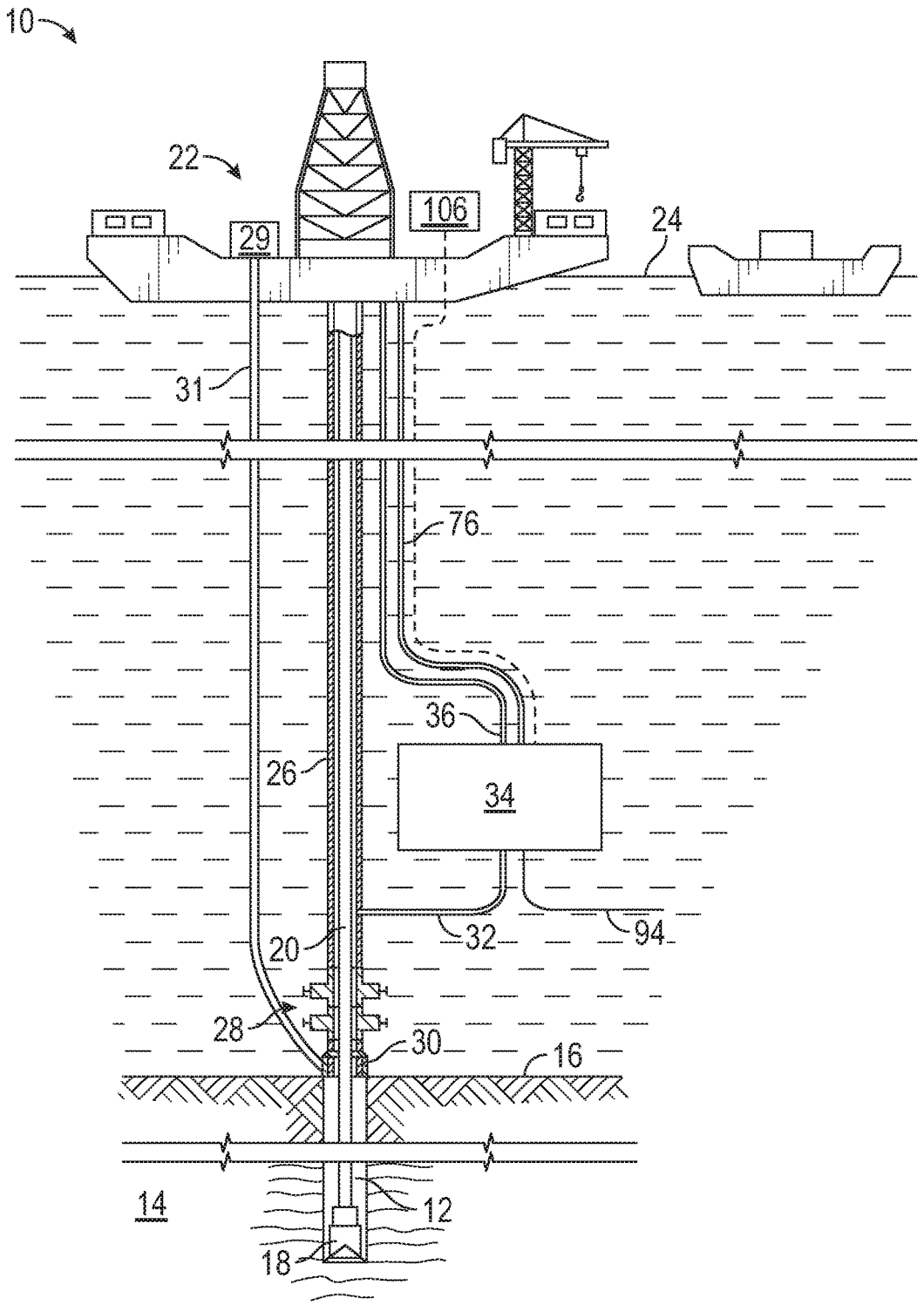
FIG. 1 is side schematic view of a subsea oil and gas drilling operation, including certain elements of the present technology.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The invention, however, is not intended to be limited to the specific terms used, and it is to be understood that each specific term includes equivalents that operate in a similar manner to accomplish a similar purpose.

FIG. 1 shows a side partial sectional view of an example embodiment of a drilling system 10 for forming a subsea wellbore 12 subsea. The wellbore 12 intersects a formation 14 that lies beneath the sea floor 16. The wellbore 12 is formed by a rotating bit 18 coupled on an end of a drill string 20 shown extending subsea from a vessel 22 floating on the sea surface 24. The drill string 20 is isolated from seawater by an annular riser 26, whose upper end connects to the vessel 22 and lower end attaches onto a blowout preventer (BOP) 28. The BOP 28 mounts onto a wellhead housing 30 that is set into the sea floor 16 over the wellbore 12. A rig pump 29 can provide drilling mud to the well via a mud supply line 31. A mud inlet line 32 is shown having an end connected to the riser 26 above BOP 28, which routes drilling mud exiting the wellbore 12 to a lift pump 34 subsea. Within the lift pump 34, drilling mud is pressurized for delivery back to the vessel 22 via mud return line 36.

Figure 2:
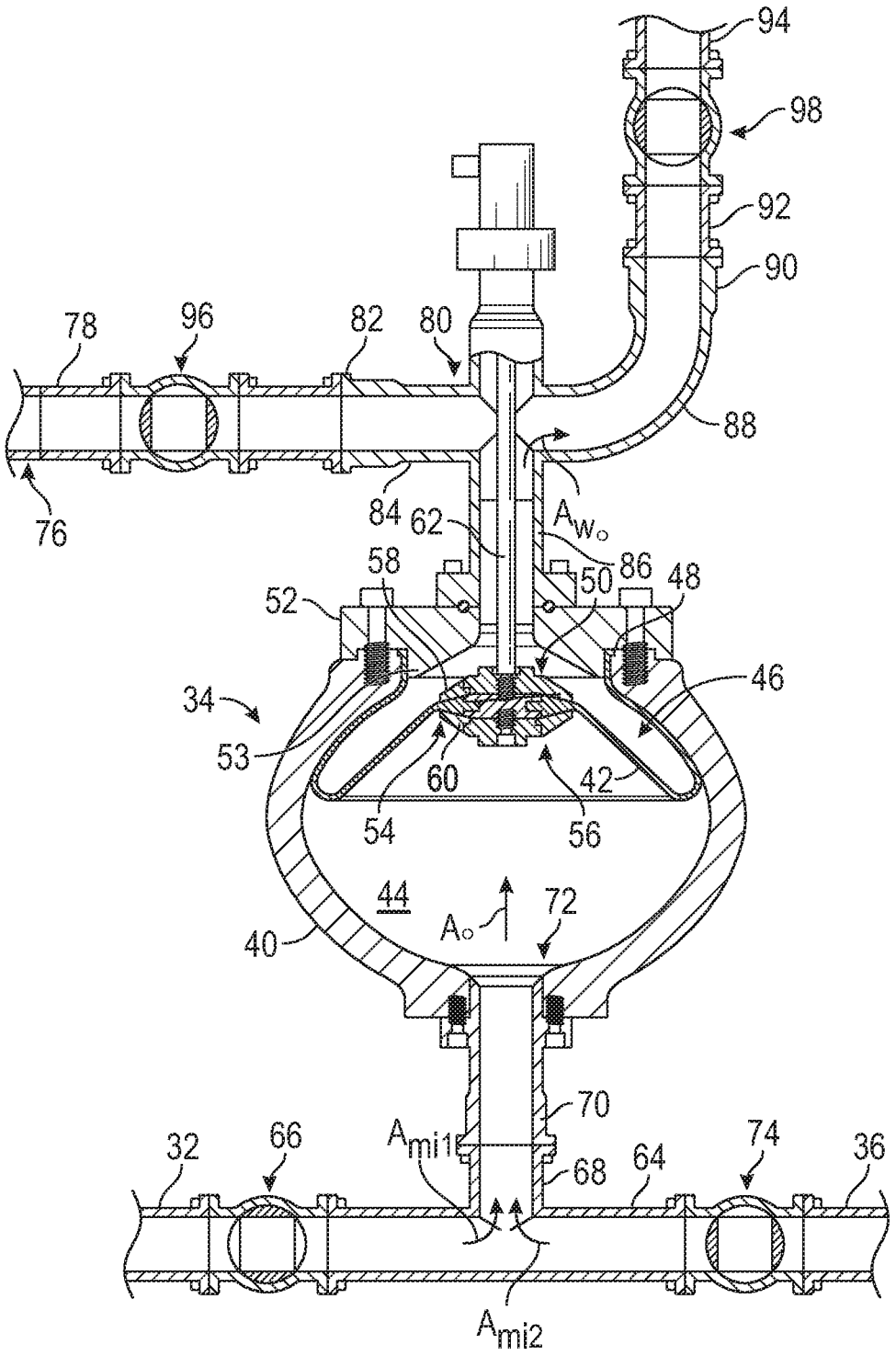
FIG. 2 is a side cross-sectional view of a mud pump in an up stroke position according to an example embodiment of the present technology.

FIG. 2 includes a side sectional view of an example of the lift pump 34. Lift pump 34 includes a generally hollow pump housing 40, which can be elliptically shaped, as shown, or can alternately be circular, rectangular, or any other shape. A flexible bladder 42 is shown within the housing 40, which partitions the space within the housing 40 to define a mud space 44 on one side of the bladder 42, and a water space 46 on an opposing side of bladder 42. As will be described in more detail below, bladder 42 provides a sealing barrier between mud space 44 and water space 46. In the example of FIG. 2, bladder 42 can have a generally elliptical shape and an upper open space 48 formed through a side wall. Upper open space 48 is shown coaxially aligned with an opening 50 formed through a side wall of the pump housing 40. A disk-like cap 52 bolts onto opening 50, where cap 52 has an axially downward depending lip 53 that coaxially inserts within opening 50 and upper open space 48. A portion of the bladder 42 adjacent its upper open space 48 can be wedged between lip 53 and opening 50 to form a sealing surface between bladder 42 and pump housing 40.

A lower open space 54 is formed on a lower end of bladder 42 distal from upper open space 48, which in the example of FIG. 2 is coaxial with upper open space 48. An elliptical bumper 56 can be shown coaxially set in the lower open space 54. The bumper 56 includes upper and lower segments 58, 60 coupled together in a clamshell-like arrangement, and respectively seal against upper and lower radial surfaces on the lower open space 54. The sealing engagement of cap 52 and bumper 56 with upper and lower open spaces 42, 54 of bladder 42, respectively, defines a flow barrier across the opposing surfaces of bladder 42. Further shown in the example of FIG. 2 is an axial rod 62 that attaches coaxially to upper segment 56, and that extends axially away from lower segment 58 and through opening 50.

Still referring to FIG. 2, a mud line 64 is shown having an inlet end connected to mud inlet line 32, and an exit end connected with mud return line 36. A mud inlet valve 66 in mud line 64 provides selective fluid communication from mud inlet line 32 to a mud lead line 68 shown branching from mud line 64. Mud lead line 68 attaches to an annular connector 70, which in the illustrated example is bolted onto housing 40. Connector 70 mounts coaxially over an opening 72 shown formed through a sidewall of housing 40 and allows communication between mud space 44 and mud line 64 through lead line 68. A mud exit valve 74 is shown in mud line 64 and provides selective communication between mud line 64 and mud return line 36.

Water may be selectively delivered into water space 46 via a water supply line 76 shown in FIG. 1 to depend from vessel 22 and connected to lift pump assembly 34. Referring back to FIG. 2, a water inlet lead line 78 has an end coupled with water supply line 76 and an opposing end attached with a manifold assembly 80 that mounts onto cap 52. The embodiment of the manifold assembly 80 of FIG. 2 includes a connector 82, mounted onto a free end of a tubular manifold inlet 84, an annular body 86, and a tubular manifold outlet 88, where the inlet and outlet 84, 88 mount on opposing lateral sides of the body 86 and are in fluid communication with body 86. Connector 82 provides a connection point for an end of water inlet lead line 78 to manifold inlet 84 so that lead line 78 is in communication with body 86. A lower end of manifold body 86 couples onto cap 52; the annulus of the manifold body 86 is in fluid communication with water space 46 through a hole in the cap 52 that registers with opening 50. An outlet connector 90 is provided on an end of manifold outlet 88 distal from manifold body 86, which has an end opposite its connection to manifold outlet 88 that is attached to a water outlet lead line 92. On an end opposite from connector 90, water outlet lead line 92 attaches to a water discharge line 94; that, as shown in FIG. 1, may optionally provide a flow path directly subsea.

A water inlet valve 96 shown in water inlet lead line 78 provides selective water communication from vessel 22 (FIG. 1), or, in some embodiments, from another source such as the sea, to water space 46 via water inlet lead line 78 and manifold assembly 80. A water outlet valve 98 shown in water outlet lead line 92 selectively provides communication between water space 46 and water discharge line 94 through manifold assembly 80 and water outlet lead line 92.

In one example of operation of pump 34 of FIG. 2, mud inlet valve 66 is in an open configuration, so that mud in mud inlet line 32 communicates into mud line 64 and mud lead line 68 as indicated by arrow $A_{Mi1}$. Further in this example, mud exit valve 74 is in a closed position thereby diverting mud flow into connector 70, through opening 72, and into mud space 44. As illustrated by arrow $A_U$, bladder 42 is urged in a direction away from opening 72 by the influx of mud, thereby imparting a force against water within water space 46. In the example, water outlet valve 98 is in an open position, so that water forced from water space 46 by bladder 42 can flow through manifold body 86 and manifold outlet 88 as illustrated by arrow $A_{Wo}$. After exiting manifold outlet 88, water is routed through water outlet lead line 92 and into water discharge line 94.

Figure 3:
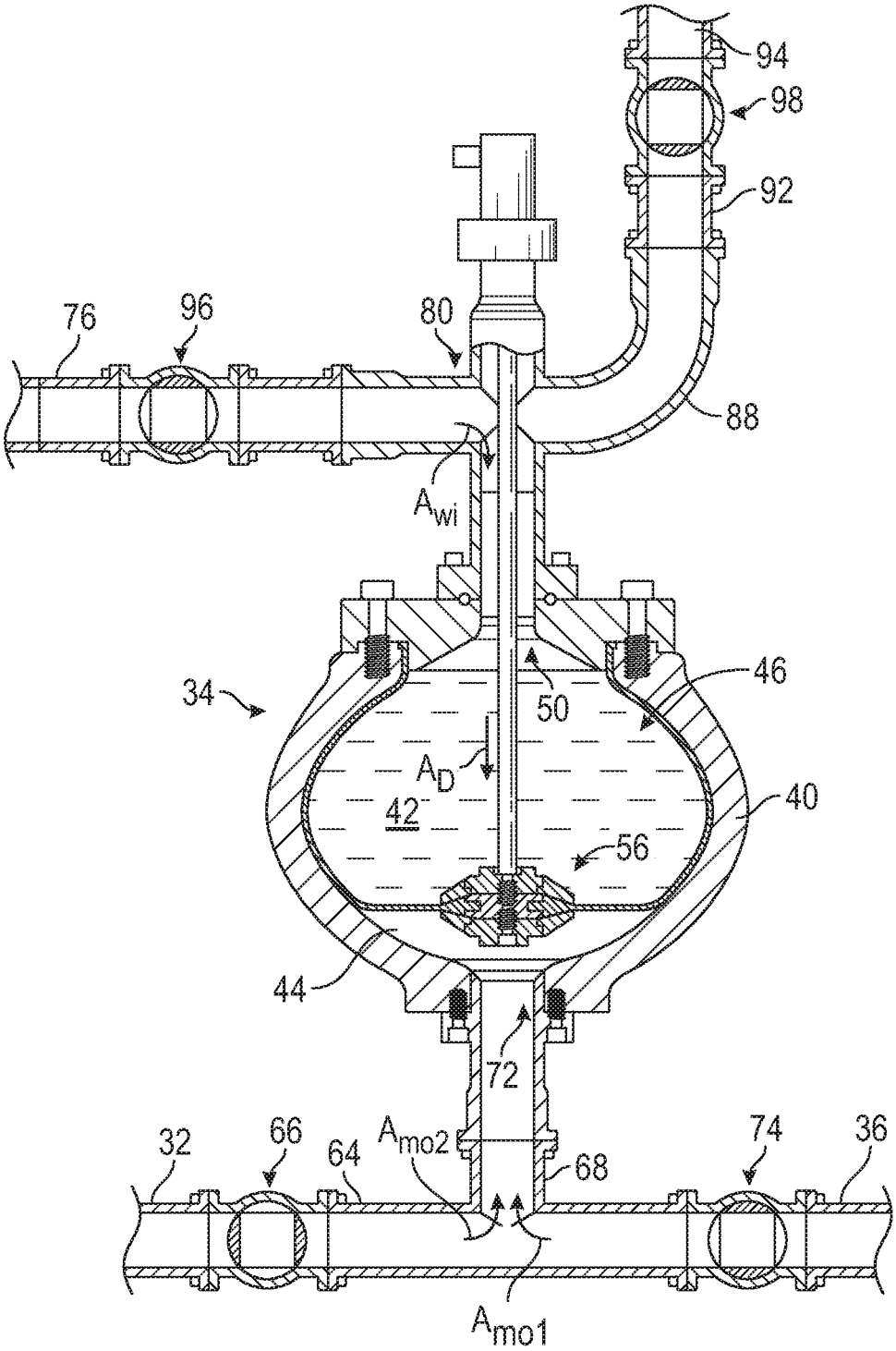
FIG. 3 is a side cross-sectional view of the mud pump of FIG. 2 in a down stroke position.

An example of pressurizing mud within mud space 44 is illustrated in FIG. 3, wherein valves 66, 98 are in a closed position and valves 96, 74 are in an open position. In this example, pressurized water from water supply line 76 is free to enter manifold assembly 80 where, as illustrated by arrow $A_{Wi}$, the water is diverted through opening 50 and into water space 46. Introducing pressurized water into water space 46 urges bladder 42 in a direction shown by arrow $A_D$. Pressurized water in the water space 46 urges bladder 42 against the mud, which pressurizes mud in mud space 44 and directs it through opening 72. After exiting opening 72, the pressurized mud flows into lead 68, where it is diverted to mud return line 36 through open mud exit valve 74 as illustrated by arrow $A_{Mo1}$. Thus, providing water at a designated pressure into water supply line 76 can sufficiently pressurize mud within mud return line 36 to force mud to flow back to vessel 22 (FIG. 1).

In a similar fashion, the pump 34 can be used to increase the pressure of mud in the wellbore 12. Such an action may be desirable, for example, to increase pressure in the wellbore 12 to compensate for annular friction losses during mud circulation in the wellbore 12. To increase mud pressure in the wellbore, and as also shown in FIG. 2, mud exit valve 74 can be opened, so that mud in mud return line 36 communicates into mud line 64 and mud lead line 68 as indicated by arrow $A_{Mi2}$. Further in this example, mud inlet valve 66 can be closed, thereby diverting mud flow into connector 70, through opening 72, and into mud space 44. As illustrated by arrow $A_U$, bladder 42 is urged in a direction away from opening 72 by the influx of mud, thereby imparting a force against water within water space 46. In the example, water outlet valve 98 is in an open position, so that water forced from water space 46 by bladder 42 can flow through manifold body 86 and manifold outlet 88 as illustrated by arrow $A_{Wo}$. After exiting manifold outlet 88, water is routed through water outlet lead line 92 and into water discharge line 94.

Referring again to FIG. 3, valves 74, 98 can then be closed, and valves 96, 66 can be opened. Pressurized water from water supply line 76 is free to enter manifold assembly 80 where, as illustrated by arrow $A_{Wi}$, the water is diverted through opening 50 and into water space 46. Introducing pressurized water into water space 46 urges bladder 42 in a direction shown by arrow $A_D$. Pressurized water in the water space 46 urges bladder 42 against the mud, which pressurizes mud in mud space 44 and directs it through opening 72. After exiting opening 72, the pressurized mud flows into lead 68, where it is diverted to mud inlet line 32 through open mud inlet valve 66, as illustrated by arrow $A_{Mo2}$. Thus, providing water at a designated pressure into water supply line 76 can sufficiently pressurize mud within mud inlet line 32 to increase pressure of the mud in the wellbore 12.

During drilling operations, it is desirable to appropriately manage bottom hole pressure, which is the pressure at the bottom of the wellbore 12 adjacent the drill bit 18. Maintenance of an appropriate bottom hole pressure increases safety, by preventing kicks or pressure surges in the well, and helps to maintain the integrity of the well. One way to maintain or increase bottom hole pressure is to adjust the inlet pressure setting on the water outlet valve 98 of the mud pump 34. If the setting is high, mud inlet pressure can be permitted to rise before the water outlet valve 98 is opened. With the water outlet valve 98 closed, the pump remains static, thereby increasing mud pressure in the wellbore 12 and ultimately the bottom hole pressure. In some alternative embodiments, pressure can be increased in the wellbore 12 by adjusting an inlet pressure setting on the mud inlet valve 66 to similar effect. In such an embodiment, if the setting is high, mud inlet pressure can be permitted to rise before the mud inlet valve 66 is opened, thereby increasing mud pressure in the wellbore 12 and ultimately the bottom hole pressure.

In order, however, to determine the appropriate setting for the water outlet valve 98 and/or the mud inlet valve 66, it is useful for the operator to be able to determine, in real time or otherwise, the bottom hole pressure in the wellbore 12. This is not a simple task, because the bottom hole pressure is affected by many parameters, including annular friction pressure and drill pipe rotation speed. The present technology provides a system and method to determine bottom hole pressure, and then to accordingly determine an appropriate mud inlet valve setting.

In particular, one aspect of the present technology includes a control system that controls the pump 34 (or plurality of pumps). In some embodiments, the control system may include software with at least two data sets. The first data set includes, for example, data about predicted annular friction pressure and the expected flow rates through the wellbore 12. The second data set includes, for example, the expected drill pipe rotation rate, and an estimation of the resultant drag on the annular friction pressure. During drilling operations, an algorithm may interpret the data in the first and second data sets, and combine that data with information such as the mud pump flow rate and the measured drill pipe rotation speed to determine an optimal setting for the water outlet valve 98 and/or the mud inlet valve 66. The algorithm can also determine to hold the mud inlet pressure steady if the mud pump flow rate overshoots or undershoots a rig pump flow rate by an operator specified margin. Once the two measured flow rates are within an operator specified margin, the algorithm can increase the valve setting of the water outlet valve 98 and/or mud inlet valve 66 as necessary based on the rig pump rate.

The software containing the compensation algorithm can communicate with a controller 106 (shown in FIGS. 1 and 4) containing a processor. The controller 106 in turn communicates with and controls the water outlet valve 198 and/or mud inlet valve 66 of the mud pump 34. Thus, based on calculations of the bottom hole pressure, and expected and measured parameters, including the annular flow rate and drill pipe rotation speed, as well as pump flow rates, the mud pump 34 (or plurality of mud pumps) can be used to effectively control bottom hole pressure.

Figure 4:
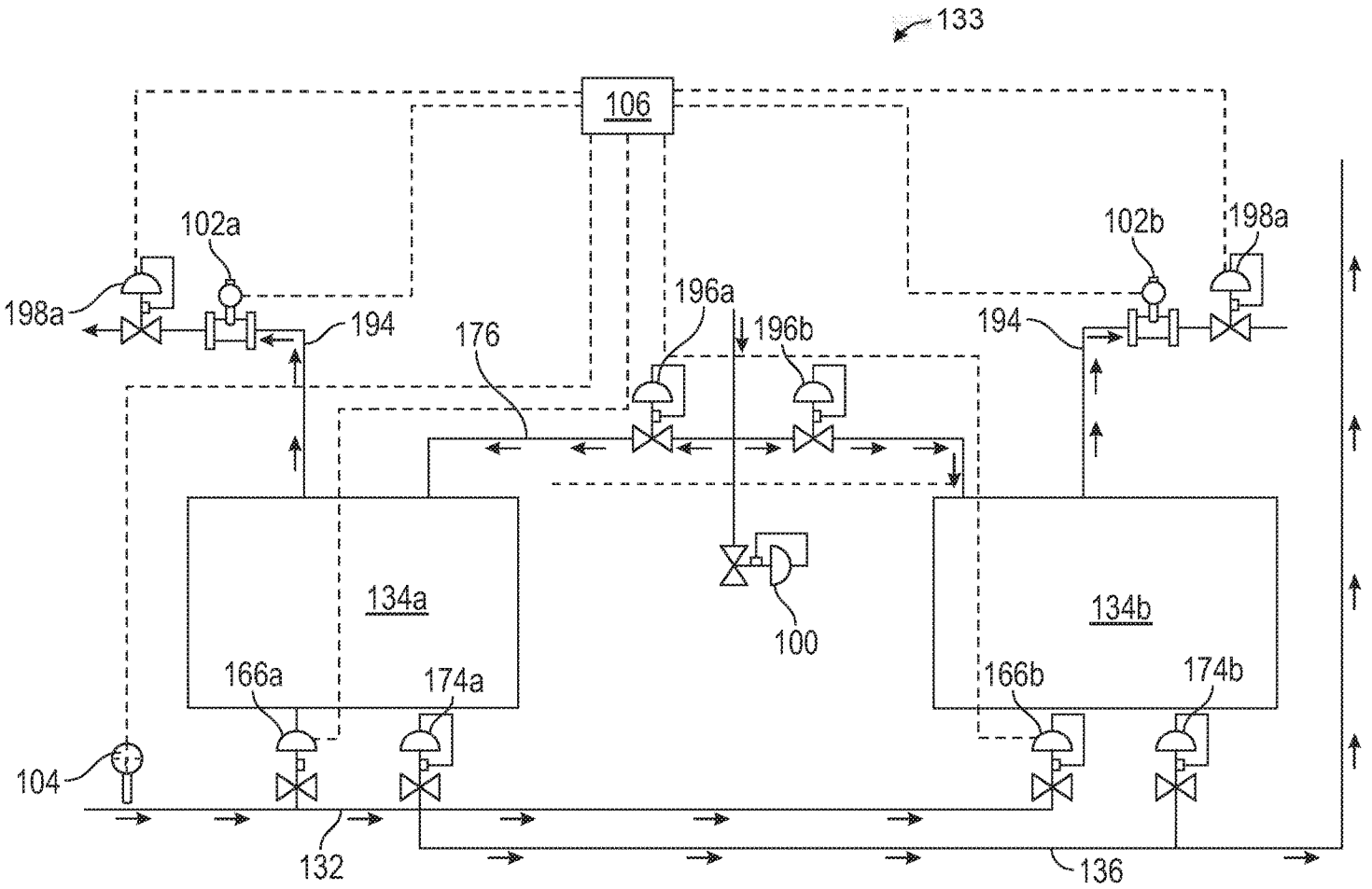
FIG. 4 is a schematic depiction of a series of mud pumps and associated additional elements according to an alternate embodiment of the present technology.

Referring now to FIG. 4, there is shown mud pump assembly 133 for use in the present technology. The mud pump assembly 133 includes two mud pumps 134*a*, 134*b*, although in practice any appropriate number of mud pumps 134 can be used. The structure of the individual mud pumps 134 can be similar to that described above with respect to mud pump 34, shown in FIGS. 2 and 3.

Each mud pump 134*a*, 134*b* is in fluid communication with a mud inlet line 132 and a mud return line 136, as well as a water supply line 176 and a water discharge line 194. Water provided to the mud pumps 134*a*, 134*b* via the water supply line 176 is controlled by water inlet valves 196*a*, 196*b*, respectively. A dump choke 100 can also be placed in the water supply line 176 to allow bleeding of excess pressure from the water supply line 176 as needed. Flow meters 102*a*, 102*b* can be positioned in water discharge lines 194, to measure the flow rate of the mud pumps 134*a*, 134*b*. The flow of water discharged from the pumps through the water discharge lines 194 is controlled by water outlet valves 198*a*, 198*b*. The mud pressure in the mud inlet line 132 is measured by a pressure transducer 104 positioned in the mud inlet line 132. The flow of mud into and out of the pumps 134*a*, 134*b* on the well side of the pumps 134*a*, 134*b* can be controlled by the mud inlet valves 166*a*, 166*b*. The flow of mud into and out of the pumps 134*a*, 134*b* on the vessel side of the pumps 134*a*, 134*b* can be controlled by the mud exit valves 174*a*, 174*b*.

During operation of the mud pump assembly 134, certain data about the mud pump flow rates can be collected by the flow meters 102*a*, 102*b* and communicated to the controller 106. In addition, data about the mud pressure in the mud inlet line 132 can be collected by the pressure transducer 104 and communicated to the controller 106. As described above, these parameters can be combined with other measured and expected parameters by the processor in the controller 106, and the processor can use the software and algorithm to determine the appropriate setpoint for the water outlet valves 198*a*, 198*b* and/or the mud inlet valves 166*a*, 166*b* to the pumps 134*a*, 134*b* to achieve a desired bottom hole pressure in the wellbore 12.

One advantage provided by the present technology is the ability to automatically and dynamically compensate for changes in annular friction pressure that may occur as a result of mud flow rate and drill pipe rotation rate changes, in order to maintain a constant bottom hole pressure. Such maintenance of a constant bottom hole pressure is advantageous because it increases safety during drilling operations, and helps to avoid problems from influx of fluids into the wellbore during drilling operations. Increased control of bottom hole pressure ultimately helps enable drilling through tighter pore pressure and fracture gradient windows.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A system for controlling bottom hole pressure in a wellbore during oil and gas drilling operations, comprising:

a bottom hole pressure controller containing data about drilling parameters and expected annular friction pressure in the wellbore;

a rig pump that pumps drilling mud into the wellbore via a mud supply line;

a mud pump that controls the flow rate of the drilling mud out of the wellbore after the drilling mud circulates through the wellbore;

a valve associated with the mud pump that has an open position for permitting drilling mud to flow through the mud pump and a closed position for preventing drilling mud from flowing through the mud pump, the valve in the open position when a pressure in the mud inlet line increases above a setpoint, and in the closed position when the pressure in the mud inlet line is below the setpoint;

a pressure transducer in the mud inlet line that measures mud inlet line pressure data and communicates the mud inlet line pressure data to the controller;

a flow meter in fluid communication with the mud pump that measures fluid flow rate through the mud pump and communicates fluid flow rate data to the controller;

wherein the controller combines the mud inlet pressure data and the fluid flow rate data with the data about drilling parameters and expected annular friction pressure to determine the setpoint of the valve to control bottom hole pressure in the wellbore.

2. The system of claim 1, wherein the data contained in the bottom hole pressure controller includes expected fluid flow rates through the mud pump, the expected drill pipe rotation rate, and an estimation of the drag on the annular friction pressure.

3. The system of claim 1, wherein the mud pump is a plurality of mud pumps.

4. The system of claim 1, wherein the valve is selected from the group consisting of a water outlet valve and a mud inlet valve.

5. The system of claim 1, further comprising:

a water supply line; and a water discharge line;

wherein the flow meter is attached to the water discharge line.

6. A method of controlling bottom hole pressure in a wellbore, the method comprising the steps of:

(a) pumping drilling mud into the wellbore;

(b) estimating the annular friction pressure in the wellbore;

(c) measuring the pressure of the drilling mud exiting the wellbore;

(d) measuring the flow rate of the drilling mud exiting the wellbore;

(e) based on the pressure of the drilling mud exiting the wellbore, the flow rate of the drilling mud exiting the wellbore, expected annular friction pressure in the wellbore, and rotational speed of drill string in the wellbore, controlling the flow rate of drilling mud exiting the wellbore to achieve a specified bottom hole pressure by opening a valve when a pressure in the mud inlet line increases above a setpoint, and closing the valve when the pressure in the mud inlet is below the setpoint.

7. The method of claim 6, wherein step (e) is performed using a mud pump having a valve, the valve movable between an open position and a closed position to allow or prevent, respectively, the flow of mud through the pump.

8. The method of claim 7, wherein step (c) further comprises:

positioning a pressure transducer in a mud inlet line between the wellbore and the pump to measure the pressure of drilling mud in the mud inlet line.

9. The method of claim 8, wherein the mud pump has a water supply line and a water discharge line, and wherein step (d) further comprises:

positioning a flow meter in the water discharge line to measure the flow rate of drilling mud through the mud pump.

10. The method of claim 9, further comprising:

transmitting data about the pressure of the drilling mud in the mud inlet line from the pressure transducer to a controller.

11. The method of claim 10, further comprising:

transmitting data about the flow rate of the drilling mud through the mud pump from the flow meter to the controller.

12. The method of claim 11, further comprising:

calculating a flow rate for drilling mud exiting the wellbore to achieve a specified bottom hole pressure in the wellbore using expected fluid flow rates through the mud pump, the expected drill pipe rotation rate, an estimation of the drag on the annular friction pressure, measured pressure in the mud inlet line as transmitted to the controller by the pressure transducer, measured flow rate of the drilling mud as transmitted by the flow meter, and actual drill pipe rotation rate; and determining a setpoint of the valve to achieve the calculated flow rate.

13. The method of claim 12, further comprising:

communicating commands from the controller to the valve to increase, decrease, or hold steady the flow rate of drilling mud between the wellbore and the mud pump to in turn adjust the bottom hole pressure in the wellbore.

14. A method of controlling bottom hole pressure in a wellbore, the method comprising the steps of:

(a) pumping drilling mud into a wellbore with a rig pump;

(b) pumping drilling mud, after circulation through the wellbore, from the wellbore to a rig with a mud pump, the mud pump having a mud inlet line, a mud outlet line, a water supply line, and a water discharge line;

(c) attaching a pressure transducer to the mud inlet line to determine the pressure of the drilling mud exiting the wellbore;

(d) attaching a flow meter to the water discharge line to measure the flow rate of drilling mud through the mud pump;

(e) combining data from the pressure transducer, data from the flow meter, expected annular friction pressure in the wellbore, and rotational speed of drill string in the wellbore, to calculate a desired flow rate of drilling mud from the wellbore to achieve a desired down hole pressure;

(f) adjusting a valve associated with the mud pump to control the flow rate of drilling mud from the wellbore.

15. The method of claim 14, wherein the valve is movable between an open position and a closed position to allow or prevent, respectively, the flow of mud through the mud inlet line from the wellbore to the mud pump.

16. The method of claim 14, further comprising:

transmitting data about the pressure of the drilling mud in the mud inlet line from the pressure transducer to a controller.

17. The method of claim 16, further comprising:

transmitting data about the flow rate of the drilling mud through the mud pump from the flow meter to the controller.

18. The method of claim 14, further comprising:

determining a setpoint of the valve to achieve the calculated flow rate.

19. The method of claim 18, further comprising:

communicating commands from the controller to the valve to increase, decrease, or hold steady the flow rate of drilling mud between the wellbore and the mud pump to in turn adjust the bottom hole pressure in the wellbore.

20. The method of claim 18, wherein the controller comprises a processor that employs an algorithm to determine the setpoint.

* * * * *